US006467644B1

(12) United States Patent
Yeh

(10) Patent No.: US 6,467,644 B1
(45) Date of Patent: Oct. 22, 2002

(54) DRINKING CONTAINER WITH BOTTOM COVER

(76) Inventor: Frank Yeh, 1019 N. Mayflower St., Anaheim, CA (US) 92801

( * ) Notice: Subject to any disclaimer, the term of this patent is extended or adjusted under 35 U.S.C. 154(b) by 0 days.

(21) Appl. No.: 09/847,247

(22) Filed: May 2, 2001

(51) Int. Cl.[7] ..... B65D 83/40
(52) U.S. Cl. ..... 220/592.17; 215/10; 215/12.2
(58) Field of Search ..... 215/12.2, 12.1, 215/2, 6, 10; 220/592.16, 592.17, 592.23, 592.24, 592.26, 506, 662, 703, 23.87, 23.89, 625

(56) References Cited

U.S. PATENT DOCUMENTS 774,041 A * 11/1904 Coffin ..... 220/592.16
1,073,983 A * 9/1913 Harrison ..... 220/592.16
4,789,073 A * 12/1988 Fine ..... 220/592.16
RE35,830 E * 6/1998 Sadlier ..... 220/592.26
5,894,948 A * 4/1999 Yeh ..... 215/12.1

* cited by examiner

*Primary Examiner*—Stephen Castellano
(74) *Attorney, Agent, or Firm*—Raymond Sun

(57) ABSTRACT

A drinking assembly has an external container having a container wall, an internal container positioned inside the external container, and a bottom cover that is removably connected to the bottom ends of the internal container and the external container. The diameter of the outer surface of the internal container is smaller than the diameter of the inner surface of the external container so that a gap is defined between the internal container and the external container when the internal container is positioned inside the external container.

9 Claims, 2 Drawing Sheets

DRINKING CONTAINER WITH BOTTOM COVER

BACKGROUND OF THE INVENTION

1. Field of the Invention

The present invention relates to a novelty drinking assembly that allows an individual to choose and change the ornamental design of the drinking assembly. In particular, the present invention relates to a drinking container assembly that comprises two containers, an internal container and an external container. A decorative piece or other item can be removably provided between the internal and the external containers.

2. Description of the Related Art

The present invention is applicable to mugs, cups and beverage containers alike, which shall hereinafter be collectively referred to as "drinking containers".

Certain conventional novelty drinking assemblies are very popular with children and adults alike. Such novelty drinking assemblies comprise two containers, an internal container and a substantially transparent external container, with a decorative mat or piece provided in the space between the internal and the external containers. The internal container has an overhanging lip portion that is adapted to engage the lip at the mouth of the external container. The decorative mat or piece may be a sheet of paper or fabric having an ornamental design, words, or a combination thereof, etched, printed or otherwise disposed on it. The decorative mat is fitted inside the external container against the inside surfaces of the external container. The internal container is positioned inside the external container, and the overhanging lip of the internal container overhangs and engages the mouth of the external container using a snap-fit engagement to hold the decorative mat in place between the two containers. Instead of a decorative mat, some novelty drinking assemblies have provided particles of different colors that are suspended in a liquid that is captured between the two containers.

These novelty drinking assemblies are popular because they allow an individual to choose or change the ornamental design of the assembly. For instance, an individual may provide a decorative piece of paper having a particular ornamental design or written message. At a later time, this same individual may decide to sew an ornamental pattern onto a fabric or other mat, and then substitute this mat for the previous piece of decorative paper. Thus, the individual is provided with an unlimited variety of different ornamental designs and messages that he or she can provide to the same drinking assembly.

Unfortunately, the snap-fit engagement between the overhanging lip of the internal container and the mouth of the external container is often not reliable, and if the user does not exercise sufficient care, can remain loose so that the internal and external containers can actually separate.

Thus, there is still a need for a novelty drinking assembly that provides a simple and secure mechanism for removably connecting the internal and external containers.

SUMMARY OF THE INVENTION

It is an object of the present invention to provide a novelty drinking assembly in which the internal and external containers are securely attached to each other.

It is another object of the present invention to provide a novelty drinking assembly in which the internal and external containers are releasably attached to each other.

It is yet another object of the present invention to provide a novelty drinking assembly in which the internal and external containers can be easily and conveniently attached to each other, and separated from each other.

The objects of the present invention may be achieved by providing a drinking assembly having an external container having a container wall, an internal container positioned inside the external container, and a bottom cover that is removably connected to the bottom ends of the internal container and the external container. The diameter of the outer surface of the internal container can be smaller than the diameter of the inner surface of the external container so that a gap is defined between the internal container and the external container when the internal container is positioned inside the external container.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
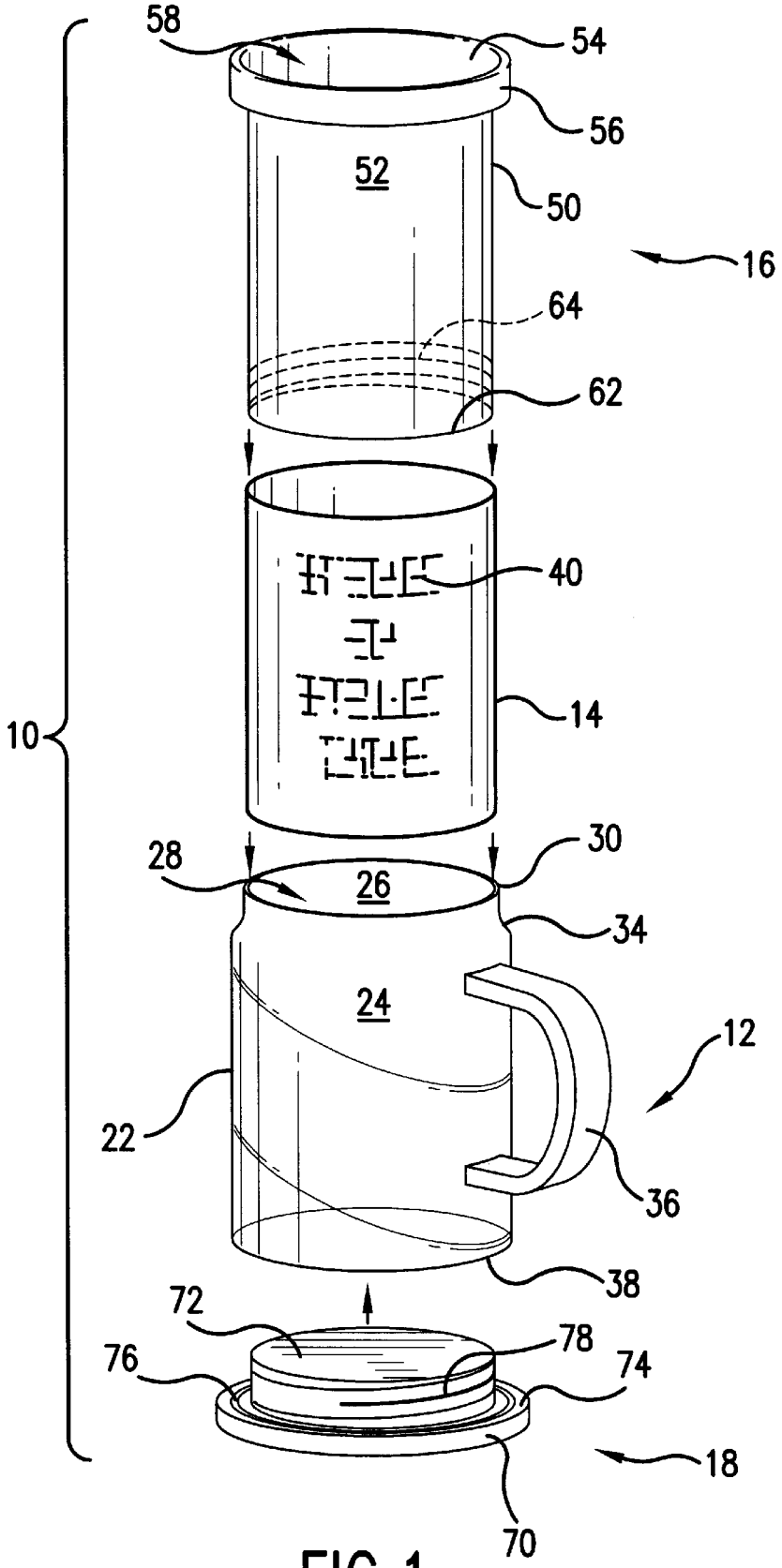
FIG. 1 is an exploded perspective view of a novelty drinking container assembly according to one embodiment of the present invention.
Figure 2:
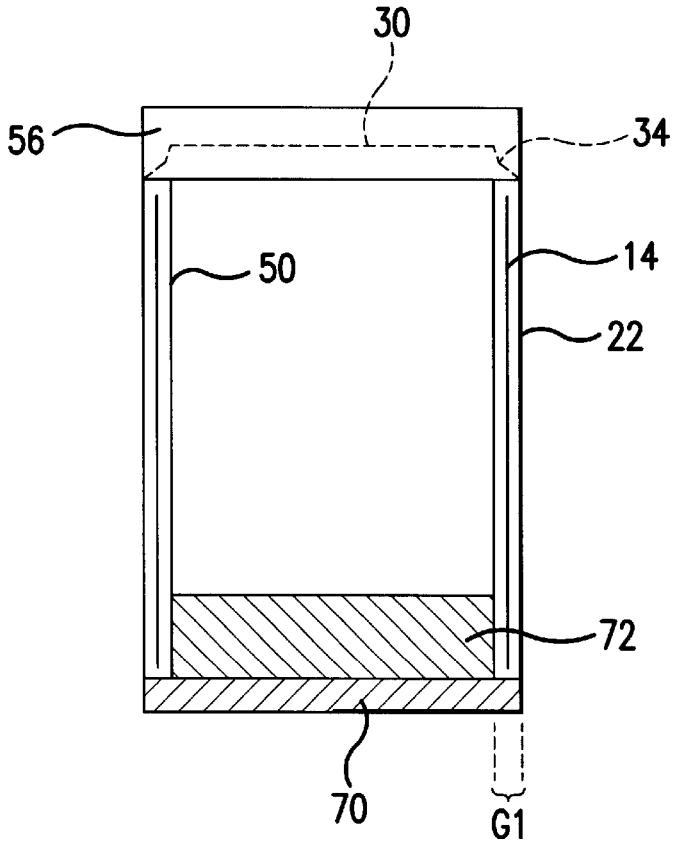
FIG. 2 is a cross-sectional view of the novelty drinking container assembly of FIG. 1.

The novelty drinking container 10 in accordance with one embodiment of the present invention is shown in FIGS. 1 and 2, and includes an external container 12, a decorative mat or piece 14, an internal container 16, and a removable bottom cover 18.

The external container 12 has a substantially cylindrical container wall 22 having an outer surface 24 and an inner surface 26. The container wall 22 is can be substantially transparent in order to display the decorative mat 14, although it is possible to provide the container wall 22 in a non-transparent material such as stainless steel. The external container 12 further includes a mouth 28 at the top end of the wall 22 having a substantially circular upper edge 30. The external container 12 also has an open bottom end 38. The region 32 about the mouth 28 is narrowed to define an annular shoulder 34. A handle 36 can be provided on the outer surface 24 for the individual to grip the drinking container 10.

Figure 3:
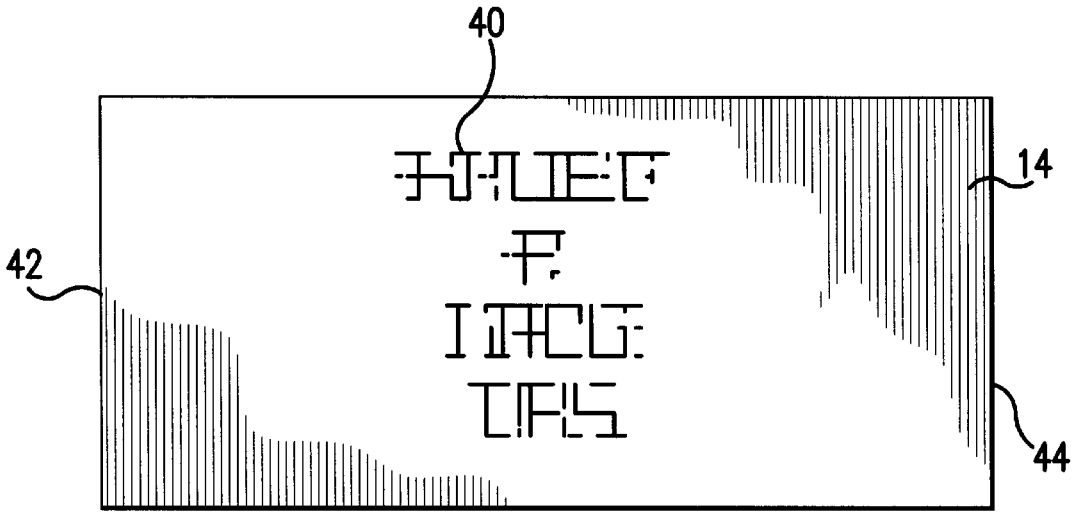
FIG. 3 is a front plan view of the decorative mat of the drinking container assembly of FIG. 1.

The decorative mat 14 can be comprised of a piece of paper, fabric mat, or P.V.C. sheet that has been rolled into a cylindrical shape. Referring to FIG. 3, the mat 14 may be provided as a flat piece without any ornamental design or message provided thereon, so that the individual can sew, draw or otherwise create an ornamental design or message 40 on the mat 14 before rolling the mat 14 to create the cylindrical shape. The mat 14 preferably has a length that allows it to be rolled into a cylindrical shape having a diameter which is substantially the same as the diameter of the inner surface 26 of the external container 12, so that the cylindrically-shaped mat 14 can be positioned against the inner surface 26. In this regard, the mat 14 can be provided at a length such that both ends 42 and 44 slightly overlap each other, thereby ensuring that the entire circumference of the container wall 22 will be covered by the mat 14. Both ends 42 and 44 may be left free or attached without departing from the spirit and scope of the present invention. The height of the mat 14 is preferably slightly less than the height of the external container 12, so that substantially the entire mat 14 can be displayed through the container wall 22.

Alternatively, the mat 14 may be provided in its cylindrical shape with an ornamental design already provided thereon. In this regard, a plurality of mats 14 having different ornamental designs and messages can be provided, so that the individual can choose between the different mats, and can substitute different mats at different times to enhance the variety of the design of the drinking container 10.

The internal container 16 has a substantially cylindrical container wall 50 having an outer surface 52 and an inner surface 54. The diameter of the outer surface 52 is preferably smaller than the diameter of the inner surface 26 of the external container 12 so that a small gap G1 is defined when the internal container 16 is positioned inside the external container 12. The internal container 16 further includes an annular overhanging lip 56 extending outwardly from its mouth 58 at the top end. The diameter of the overhanging lip 56 is preferably about the same as the diameter of the wall 22 of the external container 12, so that when the overhanging lip 56 is seated on the annular shoulder 34 of the external container 12, the outer surface 24 of the external container 12 is generally flush with the outer surface of the lip 56. The bottom end 62 of the internal container 16 is open, and has threads 64 provided on the inner surface 54 adjacent the bottom end 62. The bottom end 62 preferably has an outer diameter that is slightly less than inner diameter of the upper edge 30 of the mouth 28 of the external container 12 so that the bottom end 62 can be inserted through the mouth 28.

A bottom cover 18 is adapted to secure the internal container 16 and the external container 12 together in a sealed fashion that prevents leakage of the liquid contained inside the internal container 16. The bottom cover 18 has a generally circular bottom disk member 70 with a shaft 72 extending from about the center of the top surface 74 of the disk member 70. An annular groove 76 extends around the shaft 72 along the top surface 74. External threads 78 are provided on the annular outer surface of the shaft 72.

The internal container 16 and the external container 12 can be made from any plastic or non-plastic material (such as metal, stainless steel, aluminum, titanium, ceramic, porcelain, stoneware, earthenware or glass). The bottom cover 18 can be made from any of the above-described materials for the containers 12 and 16.

Referring now to FIGS. 1 and 2, the drinking container 10 is assembled by first positioning the decorative mat 14 inside the external container 12 adjacent the inner surface 26. The internal container 16 is then positioned inside the external container 12 (e.g., via the narrowed mouth 28) so that the mat 14 is captured in the gap G1 between the outer surface 52 of the internal container 16 and the inner surface 26 of the external container 12. The overhanging lip 56 of the internal container 16 is pushed downwardly so that the overhanging lip 56 overhangs the upper edge 30 of the mouth 28 of the external container 12, and rests against the annular shoulder 34 of the external container 12. The shaft 72 of the bottom cover 18 is then inserted into the open bottom end 62 of the internal container 16, and the bottom cover 18 is turned to cause the external threads 78 on the shaft 72 to threadably engage the internal threads 64 at the bottom end 62 of the internal container 16. When the bottom cover 18 is threadably engaged with the internal container 16, the bottom end 38 of the container wall 22 of the external container 12 will be received inside the annular groove 76 in the top surface 74 of the disk member 70, thereby tightly securing the external container 12 to both the internal container 16 and the bottom cover 18. This tight engagement inside the groove 76 ensures that liquid contained inside the internal container 16 will not leak out through the connection at the bottom ends 38 and 62 of the containers 12 and 16, respectively.

To remove or substitute the decorative mat 14, the individual merely rotates the bottom cover 18 to threadably disengage the bottom cover 18 from the bottom end 62 of the internal container 16. The mat 14 can be removed from the bottom ends 38 and 62 of the containers 12 and 16, respectively. The individual can then install another decorative mat 14 having a different ornamental design or message, and the bottom cover 18 re-engaged to the bottom end 62 for continued use of the drinking container 10.

The shapes and sizes of the internal and external containers 12 and 16 are not critical, as long as the corresponding internal and external containers 12, 16 assume substantially the same shape and size so that the internal container 16 can be fitted inside the external container 12.

As yet a further alternative, an ornamental design may be provided directly on the outer surface 52 of the internal container 16, so that the decorative pieces 14 can be omitted. In this manner, an individual may purchase a number of different internal containers 16 having different ornamental designs and messages, all adapted to fit the external container.

Therefore, the novelty drinking container 10 of the present invention provides an internal container 16 that can be conveniently and effectively secured to an external container 12. Because of the simple design and construction of the drinking container 10, it is also easy to manufacture and easy to use. Further, the materials used to fabricate the internal and external containers 12 and 16 are inexpensive, so that the drinking container 10 can be provided at low cost to the consumer.

While the description above refers to particular embodiments of the present invention, it will be understood that many modifications may be made without departing from the spirit thereof.

What is claimed is:

1. A drinking assembly, comprising:

an external container comprising a container wall having an outer surface and an inner surface, the external container including a mouth having an upper edge, and an open bottom end;

an internal container positioned inside the external container, the internal container comprising a container wall having an outer surface, an inner surface, a mouth, and an open bottom end;

wherein the diameter of the outer surface of the internal container is smaller than the diameter of the inner surface of the external container so that a gap is defined between the internal container and the external container when the internal container is positioned inside the external container;

a bottom cover having a disk member and a shaft extending from the disk member; and wherein the shaft has first threads provided thereon, and wherein the internal container has second threads provided on the inner surface of the internal container adjacent the bottom end of the internal container, wherein the first and second threads engage each other to secure the bottom cover to the bottom end of the internal container.

2. The assembly of claim 1, wherein the bottom cover further includes an annular groove positioned on the disk member around the shaft, with the bottom end of the external container received inside the annular groove.

3. The assembly of claim 1, further comprising a decorative piece having an ornamental design provided thereon, the decorative piece positioned in the gap between the inner surface of the external container and the outer surface of the internal container.

4. The assembly of claim 1, wherein the external container is made from a substantially transparent material.

5. The assembly of claim 1, further comprising an ornamental design provided on the outer surface of the internal container.

6. The assembly of claim 1, wherein the internal container further includes an annular overhanging lip extending from its mouth, the overhanging lip overhanging the upper edge of the external container.

7. The assembly of claim 6, wherein the mouth of the external container has a narrowed region that defines an annular shoulder, with the overhanging lip seated on the annular shoulder.

8. The assembly of claim 1, wherein the container wall of the external container is cylindrical.

9. The assembly of claim 1, wherein the container wall of the internal container is cylindrical.

* * * * *